US006688790B2

(12) United States Patent
Ito

(10) Patent No.: US 6,688,790 B2
(45) Date of Patent: Feb. 10, 2004

(54) KEYBOARD INPUT DEVICE

(75) Inventor: Hideki Ito, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/383,357

(22) Filed: Mar. 6, 2003

(65) Prior Publication Data

US 2003/0170061 A1 Sep. 11, 2003

(30) Foreign Application Priority Data

Mar. 11, 2002 (JP) ..... 2002-065485

(51) Int. Cl.[7] ..... B41J 5/08

(52) U.S. Cl. ..... 400/490; 400/491.2; 400/491.3; 361/680; 174/261; 174/262; 174/250; 174/267

(58) Field of Search ..... 400/490, 491.2, 400/491.3; 174/261, 262, 267, 250; 361/680

(56) References Cited

U.S. PATENT DOCUMENTS 3,983,022 A * 9/1976 Auyang et al. ..... 204/192.12
4,470,874 A * 9/1984 Bartush et al. ..... 438/631
4,956,313 A * 9/1990 Cote et al. ..... 438/672
4,973,562 A * 11/1990 Den Blanken ..... 438/296
5,441,094 A * 8/1995 Pasch ..... 438/690
5,584,740 A * 12/1996 Hsu et al. ..... 445/49
6,528,874 B1 * 3/2003 Iijima et al. ..... 257/700

FOREIGN PATENT DOCUMENTS

JP 61049491 A * 3/1986 ..... H05K/1/02
JP H7-245454 9/1995

* cited by examiner

*Primary Examiner*—Andrew H. Hirshfeld
*Assistant Examiner*—Andrea H. Evans
(74) *Attorney, Agent, or Firm*—Brinks Hofer Gilson & Lione

(57) ABSTRACT

A keyboard input device comprises a lever-mounting plate for supporting the lower ends of a pair of lever members in an engaged manner, a circuit board on which the lever-mounting plate is placed and is forming a circuit pattern on a surface facing the lever-mounting plate, a hollow rubber spring adhered onto the circuit board, and a key top supported by the pair of lever members and is urged by the elastic urging force of the rubber spring in a direction to separate away from the circuit board, wherein the circuit board has an insulating layer for insulating and covering the circuit pattern, the insulating layer having a surface area larger than that of the lever-mounting plate permitting the lever-mounting plate to be placed thereon via an uppermost layer.

3 Claims, 3 Drawing Sheets

KEYBOARD INPUT DEVICE

BACKGROUND OF THE INVENTION

1. Field of the Invention

This invention relates to keyboard input device and, particularly, to a keyboard input device used as an input device for personal computers.

2. Description of the Related Art

Thin keyboard input devices usually adapted to notebook type personal computers, have been proposed in a variety of kinds in which a pair of lever members are intersecting being linked together so as to serve as members for supporting the key tops and being resiliently urged upward by hollow rubber springs, in a manner that the intersecting angles of the pair of lever members that are linked together vary accompanying the ascending/descending motion of the key tops.

There has been proposed a keyboard input device in which, for example, a lever member of which the upper end is rotatably engaged with the back surface of the key top and another lever member of which the upper end is slidably engaged with the back surface of the key top, are linked together at their intersecting portions, and the key tops are supported by the pair of integrated lever members so as to be moved up and down.

Referring to FIG. 6, the switching unit of the keyboard input device of this kind has a dome-like hollow rubber spring 21, and wherein a moving contact 21*b* is formed at the ceiling portion 21*a* in the cavity of the rubber spring 21.

The rubber spring 21 is adhered to a switch board 22 with an adhesive over the whole circumference of a lower end 21*d* of a skirt-like outer peripheral wall 21*c* thereof.

The switching board 22 has a pair of fixed contacts 22*a* and 22*a* at a portion facing the moving contact 21*b* so as to produce the switching operation upon contacted by the moving contact 21*b*.

In the switching board 22, further, a first circuit pattern 22*b* and a second circuit pattern 22*c* that are running being connected to the pair of fixed contacts 22*a* and 22*a*, are partly laminated in two layers as shown in FIG. 7.

The first circuit pattern 22*b* is provided with a first insulating layer 23 comprising two resist layers covering the upper portion thereof. On the first insulating layer 23 is formed a second circuit pattern 22*c* traversing (crossing) the first circuit pattern 22*b*, and on the second-circuit pattern 22*c* is formed a second insulating layer 24.

The first and second circuit patterns 22*b* and 22*c* which are locally formed in two layers, inclusive of the first and second insulating layers 23 and 24, are protruding having a height A from the surface of the switching board 22.

Even when the first circuit pattern 22*b* of a single layer is formed as shown in FIG. 8, the switching board 22 protrudes to a height B though it is smaller than the height A.

On the switching board 22 of a portion to where the rubber spring 21 is adhered, further, there is placed a lever-mounting plate 25 mounting a pair of lever members (not shown) intersecting in an X shape being linked together so as to ascend and descend.

As shown in FIGS. 7 and 8, the lever-mounting plate 25 is placed on the first and second circuit patterns 22*b* and 22*c* of the two-layer structure, or on the first circuit pattern 22*b* of the one-layer structure.

The switching board 22 mounting the above lever-mounting plate 25 is placed on a flat metal plate 26 and is supported in a housing that is not shown.

In the above conventional keyboard input device, when the key top (not shown) on the rubber spring 21 is pushed down, the outer peripheral wall 21*c* of the rubber spring 21 undergoes the elastic deformation permitting the moving contact 21*b* to descend.

Then, the moving contact 21*b* comes in contact with the pair of fixed contacts 22*a* to turn the switch on.

In the conventional keyboard input device in which the lever-mounting plate 25 is mounted on the insulating layers 23 and 24 that are partly protruding maintaining a height A or B above the surface of the switching board 22, however, the attitude of the lever-mounting plate 25 loses stability, the lever-mounting plate 25 rattles when the key top is depressed, and the feeling for depressing the key top is deteriorated.

Besides, since the first and second insulating layers 23 and 24 are protruding to a height of A or B, a depression of the key top causes the load of depression to be locally and repetitively exerted on the first and second insulating layers 23 and 24.

Due to the load of depression locally and repetitively exerted, therefore, cracks develop in the first and second insulating layers 23 and 24, whereby the second circuit pattern 22*c* formed on the first insulating layer 23 is broken and the breakdown voltage characteristics are deteriorated.

Or, water infiltrates through the cracks causing the first and second circuit patterns 22*b* and 22*c* to be corroded and broken.

SUMMARY OF THE INVENTION

This invention was accomplished in view of the above problems, and has an object of providing a keyboard input device of a high quality maintaining good feeling of operation when the key tops are depressed and suppressing the occurrence of cracks in the insulating layers on the circuit patterns.

As a first means for solving the above problem, a keyboard input device of the invention comprises a pair of lever members rotatably coupled at their intersecting portions, a lever-mounting plate for supporting the lower ends of the pair of lever members in an engaged manner, a circuit board on which the lever-mounting plate is placed and is forming a circuit pattern on a surface facing the lever-mounting plate, a hollow rubber spring mounted on the circuit board, and a key top supported by the pair of lever members and is urged by the elastic urging force of the rubber spring in a direction to separate away from the circuit board, wherein the circuit board forms an insulating layer for insulating and covering the circuit pattern, the insulating layer having a surface area larger than that of the lever-mounting plate permitting the lever-mounting plate to be placed thereon.

The insulating layer is constituted by at least two or more resist layers formed being laminated on the circuit board inclusive of the circuit pattern.

The insulating layer forms a protruded portion by causing the resist layer to be protruded on the circuit pattern, a dummy layer of a size equal to the height of the protruded portion is formed on the slope portions around the protruded portion, and an uppermost layer comprising the resist layer is laminated on the dummy layer and on the protruded portion.

DESCRIPTION OF THE PREFERRED EMBODIMENTS

Figure 1:
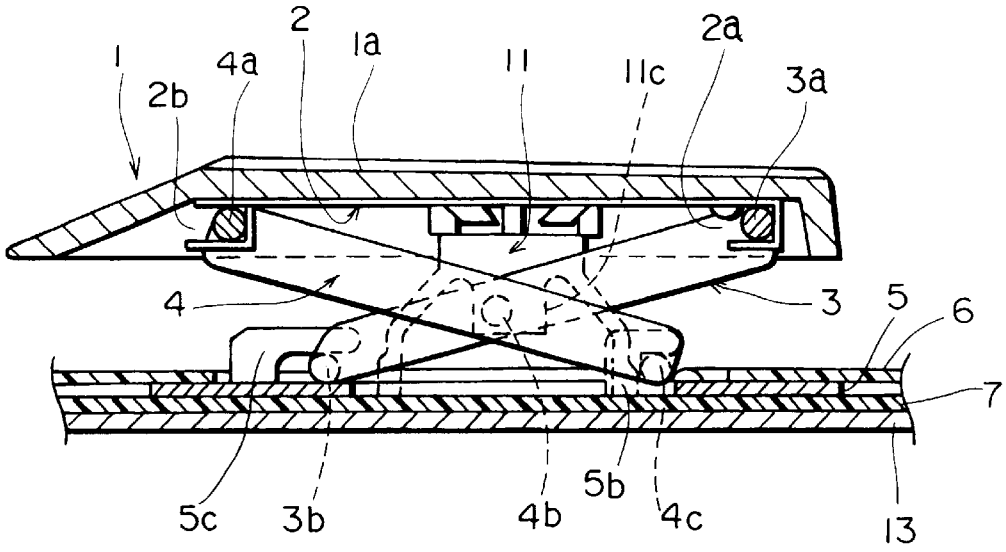
FIG. 1 is a sectional view illustrating a major portion of a keyboard input device of the invention.
Figure 2:
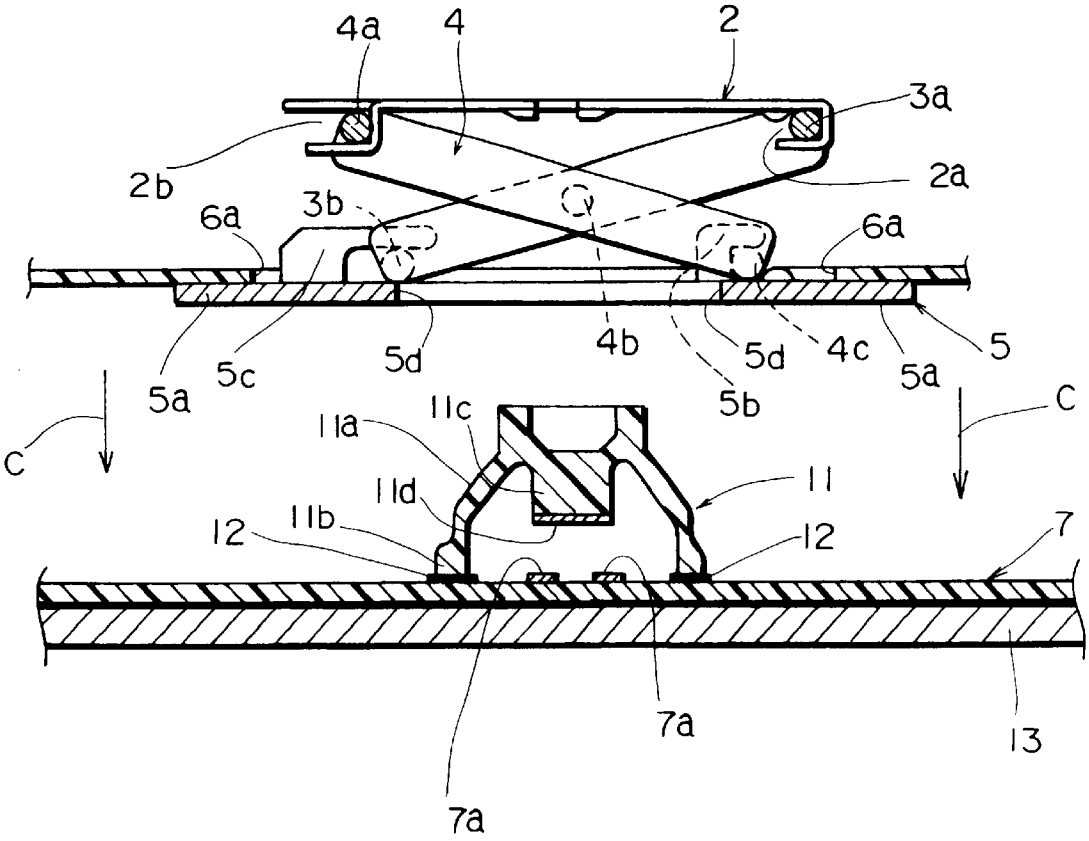
FIG. 2 is a view schematically illustrating how to mount a lever-mounting plate on a circuit board according to the invention.
Figure 3:
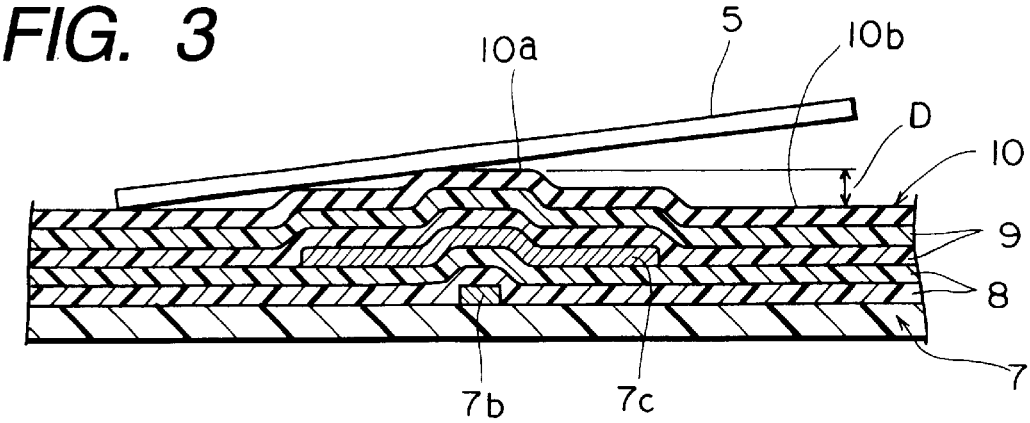
FIG. 3 is a view illustrating a relationship between the circuit board and the lever-mounting plate according to the invention.
Figure 4:
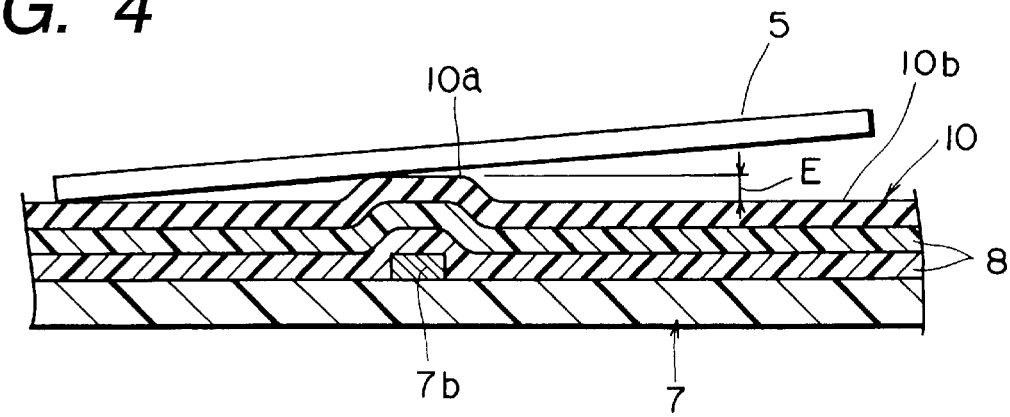
FIG. 4 is a view illustrating a relationship between the circuit board and the lever-mounting plate according to the invention.

A keyboard input device of the invention will now be described with reference to the drawings. FIG. 1 is a sectional view illustrating a major portion of a keyboard input device of the invention, FIG. 2 is a view schematically illustrating how to mount a lever-mounting plate on a sheet switch according to the invention, and FIGS. 3 and 4 are views illustrating relationships between the circuit board and the lever-mounting plate according to the invention.

Referring, first, to FIG. 1, the keyboard input device of the invention has a key top 1 made of a resin material and arranged at an uppermost part as shown in FIG. 1. On the upper surface of the key top 1 is formed an operation surface la that can be depressed by a finger.

An actuator 2 made of a metal plate such as a stainless steel plate is fastened to the lower surface of the key top 1. The actuator 2 has a rotary engaging portion 2*a* formed by folding a right end thereof in nearly a U-shape and a slide engaging portion 2*b* formed by folding a left end thereof in nearly a U-shape.

The rotary engaging portion 2*a* and the slide engaging portion 2*b* are opening toward the same left direction in the drawing.

An upper end 3*a* of a first lever member 3 is rotatably engaged with the rotary engaging portion 2*a* of the actuator 2, and an upper end 4*a* of a second lever member 4 is slidably engaged with the slide engaging portion 2*b*.

The first and second lever members 3 and 4 are linked together so as to turn with a coupling pin 4*b* at the intersecting portion as a fulcrum.

Upon turning the first and second lever members 3 and 4 with the coupling pin 4*b* as a fulcrum, the upper ends 3*a* and 4*a* vary the distance and move up and down.

Further, the lower ends 3*b* and 4*c* of the first and second lever members 3 and 4 are supported by the lever-mounting plate 5.

Referring to FIG. 2, the lever-mounting plate 5 is forming a flat base portion 5*a* of nearly a rectangular outer shape that is obtained by press-working a metal plate such as of a stainless steel. Further, the right side of the base portion 5*a* is raised to form a rotary engaging portion 5*b* of nearly an L-shape. The lower end 4*c* of the second lever member 4 is rotatably engaged with the rotary engaging portion 5*b*.

Further, the left side of the base portion 5*a* is raised to form a slide engaging portion 5*c* of nearly an L-shape. The lower end 3*b* of the first lever member 3 is slidably engaged with the slide engaging portion 5*c*.

The base portion 5*a* has a circular through hole 5*d* formed in nearly the central portion thereof so that a rubber spring 8 that will be described later can be inserted therein.

The rotary engaging portion 5*b* and the slide engaging portion 5*c* are opening toward the same right direction in the drawing.

At the time of assembling, the lever-mounting plate 5 is temporarily secured to a support plate 6 to constitute a unit.

The support plate 6 has openings 6*a* by which the lever-mounting plate 5 can be temporarily secured. When a rotary support portion 6*b* and a slide support portion 5*c* of the lever-mounting plate 5 are inserted in the openings 6*a* from the lower side toward the upper side, snap-engaging portions (not shown) formed on the lever-mounting plate 5 are snap-engaged with the openings 6*a*.

At the same time, further, the right and left both ends of the base portion 5*a* are brought into contact with the lower surface of the support plate 6, whereby the lever-mounting plate 5 is limited from moving up and down, and is temporarily secured to the support plate 6 due to snap-engagement.

The above lever-mounting plate 5 supports the first and second lever members 3 and 4 that are linked together thereby to assemble a switch unit.

A film-like circuit board 7 is arranged in the lower part of the lever-mounting plate 5 which is temporarily secured to the support plate 6, and a pair of fixed contacts 7*a* and 7*a* are formed on one surface of the circuit board 7 facing each other maintaining a predetermined gap.

Referring to FIG. 3, on the circuit board 7 is formed a first circuit pattern 7*b* which may be a silver pattern or the like pattern that is running being connected to the fixed contact 7*a*. On the first circuit pattern 7*b* is formed a first insulating layer 8 constituted by at least two or more resist layers.

The first insulating layer 8 has a surface area larger than that of the lever-mounting plate 5.

On the first insulating layer 8 is formed a second circuit pattern 7*c* traversing (crossing) the first circuit pattern 7*b*. A second insulating layer 9 constituted by at least two or more resist layers like the first insulating layer 8, is formed on the second circuit pattern 7*c* and on the first insulating layer 8 of portions exposed beyond the second circuit pattern 7*c*.

Like the first insulating layer 8, the second insulating layer 9, too, has a surface area larger than that of the lever-mounting plate 5.

The first and second insulating layers 8 and 9 are constituted by two or more resist layers, respectively, because of the reason that a single resist layer has a limitation on the thickness thereof. In order to seal pinholes that occur at the time of printing resist layers, there are formed at least two or more resist layers. By laminating at least two or more resist layers, further, the respective insulating layers 8 and 9 maintain thickness to exhibit increased mechanical strength. Even when the load of depression is exerted on the key top 1 through the lever-mounting plate 5 placed on the uppermost layer 10 that will be described later, therefore, no crack occur in the insulating layers 8 and 9.

The uppermost layer 10 which is, for example, a black resist layer is formed on the second insulating layer 9. The surface of the uppermost layer 10 can be seen through gaps among the plurality of key tops 1 arranged in the upper part. Therefore, the color is changed to meet the user's requirement.

The uppermost layer 10 has a protruded portion 10*a* formed on the first circuit pattern 7*b* being protruded depending upon the thickness of the first circuit pattern 7*b*.

Further, a slope portion 10*b* is formed in the periphery of the protruded portion 10*a*, and a step between the protruded portion 10*a* and the boundary portion 10*b* has a height D which is smaller than the heights A and B in the prior art.

Referring to FIG. 4 in which the first circuit pattern 7*b* only is running, the first insulating layer 8 constituted by two resist layers is formed on the first circuit pattern 7*b*, and the uppermost layer 10 is formed on the first insulating layer 8.

In the circuit board 7 on which the first circuit pattern 7*b* only is running, the step between the protruded portion 10*a* of the uppermost layer 10 and the slope portion 10*b* has a height E. The height E is nearly equal to the thickness of the first circuit pattern 7*b* and is smaller than the height D shown in FIG. 3.

A hollow rubber spring 11 having a dome-like outer shape is arranged over the side facing the pair of fixed contacts 7*a* and 7*a*.

The rubber spring 11 is formed hollow, is adhered at its skirt-like outer peripheral wall 11*a* and at the lower end 11*b* of the outer peripheral wall 11*a* to the circuit board 7 with an adhesive 12, so that the circuit board 7 and the rubber spring 11 are formed integrally together.

The rubber spring 11 has a moving contact 11*d* formed of a film of carbon or the like maintaining a predetermined thickness on a ceiling portion 11*c* in the cavity.

The circuit board 7 forming the rubber spring 11 integrally together is placed on a flat bottom plate 13 made of a metal plate such as aluminum plate.

The bottom plate 13 mounting the circuit board 7 is mounted in a housing that is not shown.

To assemble the keyboard input device of this invention as shown in FIG. 2, the first and second lever members 3 and 4 are supported on the lever-mounting plate 5 to assemble a switching unit.

The lever-mounting plate 5 in the form of a unit is temporarily secured by being snap-engaged with the openings 6*a* of the support plate 6.

The lower ends 3*b*, 4*c* of the first and second lever members 3, 4 are supported by the lever-mounting plate 5 which is temporarily secured to the support plate 6.

Further, the actuator 2 is mounted on the upper ends 3a and 4*a* of the pair of lever members 3 and 4.

Thereafter, the through hole 5*d* of the lever-mounting plate 5 is brought to a position of the lower rubber spring 11, and the support plate 6 is lowered as indicated by an arrow C, whereby he lever-mounting plate 5 is positioned on the circuit board 7, and the rubber spring 11 penetrates through the hole 5*d* so as to protrude upward beyond the lever-mounting plate 5.

Due to the elastic urging force of the rubber spring 11, therefore, the actuator 2 moves upward, and the first and second lever members 3 and 4 are liked together intersecting in an x shape.

Next, the key top 1 is positioned on the actuator 2 and is engaged with the actuator 2 to assemble the keyboard input device of the invention.

In the thus assembled keyboard input device of the invention, when the operation surface 1*a* of the key top 1 on the rubber spring 11 is depressed down, the outer peripheral wall 11*b* of the rubber spring 11 undergoes the elastic deformation and the moving contact 11*d* descends.

Then, the moving contact 11*d* that has descended comes in contact with the pair of fixed contacts 7*a* to turn the switching circuit (not shown) on When the key top 1 is no longer depressed, the moving contact 11*d* separates away from the fixed contacts 7*a*, 7*a* due to the elastic force of the rubber spring 11, whereby the switching circuit is turned off and the rubber spring 11 returns to the initial state of its original shape.

Further, the protruded portion 10*a* has a step which is as small as D and the lever-mounting plate 5 is placed on the uppermost layer 10 having a surface area larger than that of the lever-mounting plate 5. Even when the key top 1 is depressed, therefore, the lever-mounting plate 5 rattles little.

Figure 5:
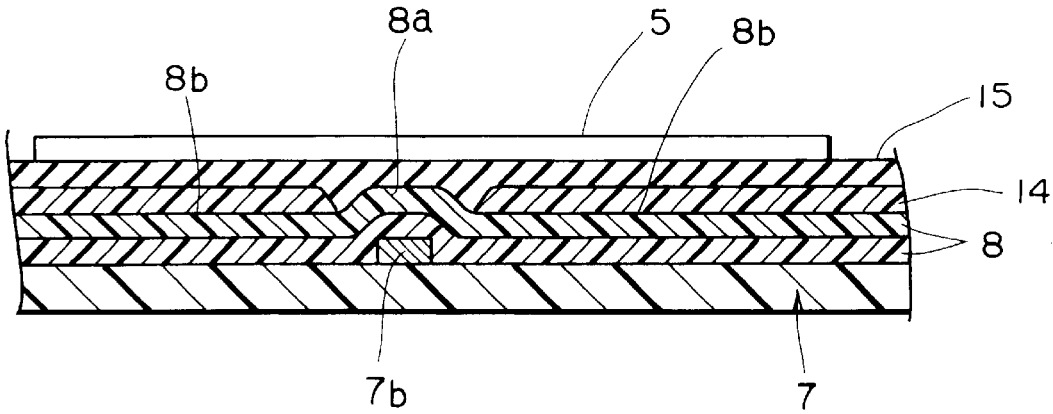
FIG. 5 is a view illustrating a relationship between the circuit board and the lever-mounting plate according to the invention.
Figure 6:
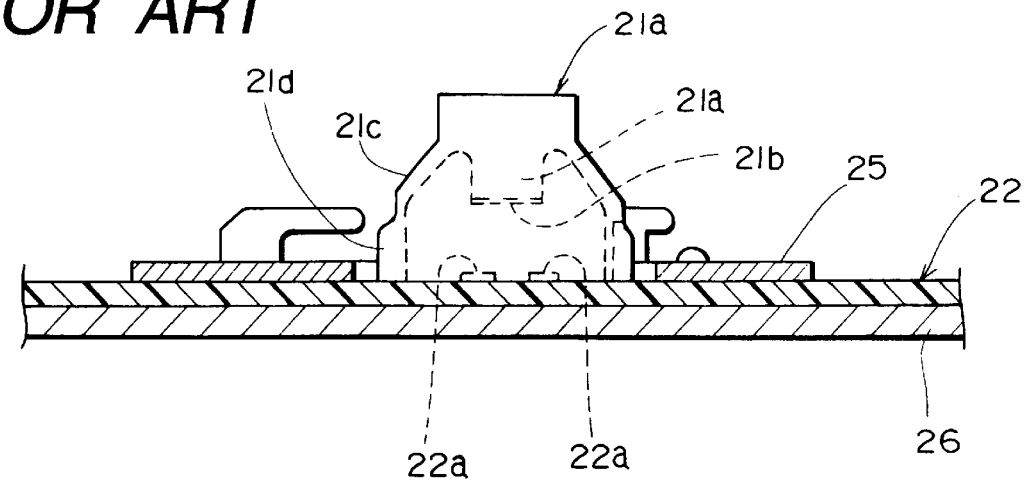
FIG. 6 PRIOR ART
FIG. 6 is a view illustrating a relationship between the circuit board and the lever-mounting plate according to a prior art.
Figure 7:
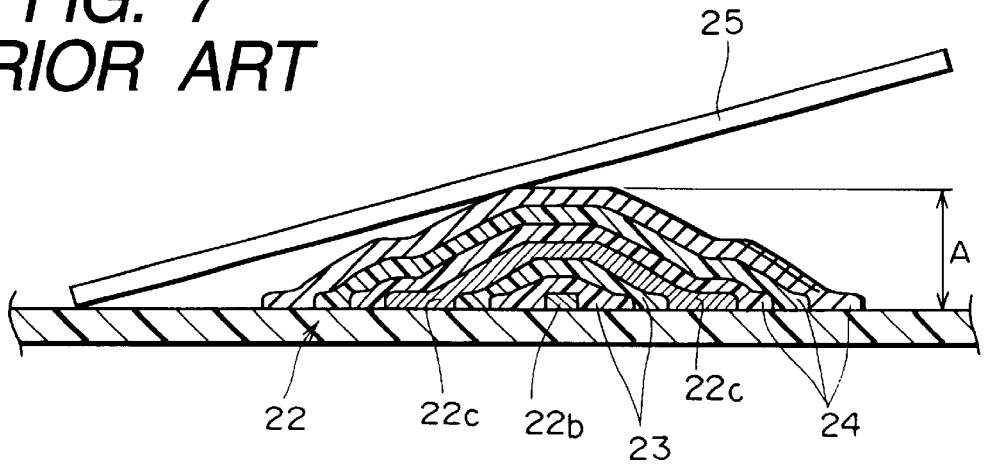
FIG. 7 PRIOR ART
FIG. 7 is a view illustrating a relationship between the circuit board and the lever-mounting plate according to a prior art.
Figure 8:
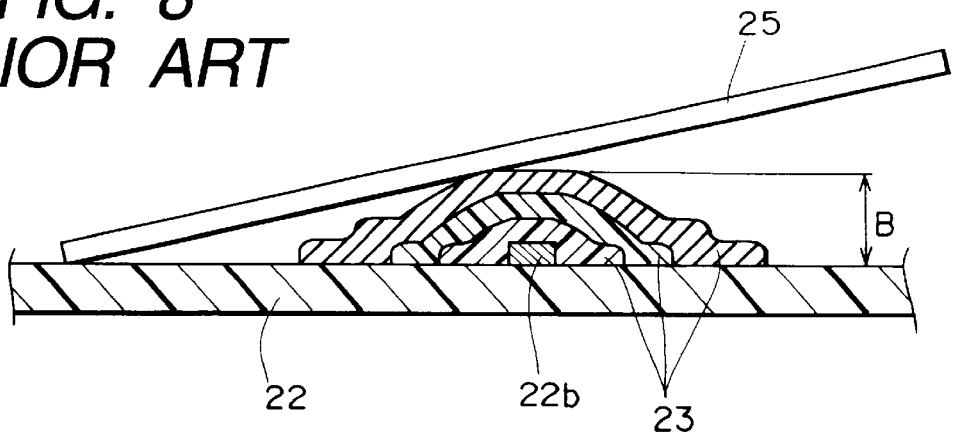
FIG. 8 PRIOR ART
FIG. 8 is a view illustrating a relationship between the circuit board and the lever-mounting plate according to a prior art.

Referring to FIG. 5 illustrating another embodiment of the invention, the first circuit pattern 7*b* only is formed on the circuit board 7. Here, on the first circuit pattern 7*b* is formed the first insulating layer 8 constituted by two resist layers, a dummy layer 14 of a resist layer having a size nearly the same as the height of the protruded portion 8*a* is formed on the slope portion 8*b* surrounding the protruded portion 8*a* of the first insulating layer 8, and the uppermost layer 15 which is a black resist layer is formed on the dummy layer 14 and on the protruded portion 8*a*. The dummy layer 14 has a surface area equal to that of the first insulating layer 8.

As shown in FIG. 5, the surface of the uppermost layer 15 can be formed flat. Even when the key top 1 is depressed, therefore, the lever-mounting plate 5 on the uppermost layer 15 does not rattle.

In the embodiment of the invention, the first and second insulating layers 8 and 9 are constituted by two resist layers, respectively. The first and second insulating layers 8 and 9, however, may be constituted by three or more resist layers, respectively.

That is, the first and second insulating layers 8 and 9 may be formed by at least two or more resist layers, respectively.

In the keyboard input device of the invention as described above, an insulating layer is formed for insulating and covering the circuit pattern, the insulating layer having a surface area larger than that of the lever-mounting plate, and the lever-mounting plate is placed on the insulating layer. This makes it possible to lower the height of the protruded portion of the insulating layer formed on the circuit pattern and, hence, to decrease the rattling of the lever-mounting plate when the key top is depressed. Thus, there is provided a keyboard input device featuring excellent key top operability.

The insulating layer is constituted by a plurality of resist layers laminated on the circuit board which includes the circuit pattern. It is therefore made possible to seal the pinholes occurring in the resist layer and to improve the voltage characteristics of the circuit pattern.

Further, the insulating layer has a protruded portion protruding on the circuit pattern depending upon the thickness of the circuit pattern, a dummy layer of a height same as the height of the protruded portion is formed in the slope portion around the protruded portion, and the uppermost layer constituted by a resist layer is laminated on the dummy layer and on the protruded portion, making it easy to flatten the uppermost layer and to reliably prevent the lever-mounting plate from rattling.

Since the lever-mounting plate does not rattle, the load of depression can be dispersed at the time when the key top is depressed.

Accordingly, no crack occurs in the insulating layer and the circuit patterns are not broken.

What is claimed is:

1. A keyboard input device comprising a pair of lever members rotatably coupled at intersecting portions, a lever-mounting plate for supporting lower ends of the pair of lever members in an engaged manner, a circuit board on which the lever-mounting plate is placed and is forming a circuit pattern on a surface facing the lever-mounting plate, a hollow rubber spring mounted on the circuit board, and a key top supported by the pair of lever members and is urged by the elastic urging force of the rubber spring in a direction to separate away from the circuit board, wherein the circuit board forms an insulating layer for insulating and covering the circuit pattern, the insulating layer having a surface area larger than that of the lever-mounting plate permitting the lever-mounting plate to be placed thereon.

2. A keyboard input device according to claim 1, wherein the insulating layer comprises at least two resist layers that are laminated on the circuit board inclusive of the circuit pattern.

3. A keyboard input device according to claim 2, wherein the insulating layer forms a protruded portion by causing the resist layer to be protruded on the circuit pattern, a dummy layer of a size equal to a height of the protruded portion is formed in slope portions around the protruded portion, and an uppermost layer comprising the resist layer is laminated on the dummy layer and on the protruded portion.

* * * * *